United States Patent [19]

Hartmannsgruber et al.

[11] Patent Number: 4,630,434

[45] Date of Patent: Dec. 23, 1986

[54] ROVING BLOCKING MECHANISM ON DRAW FRAMES OF SPINNING MACHINES

[75] Inventors: Max Hartmannsgruber, Kirchheim; Michael von Ronai-Horvath, Ludwigsburg; Kurt Seebo, Esslingen; Bernhard Schoenung, Filderstadt, all of Fed. Rep. of Germany

[73] Assignee: SKF Textilmaschinen-Komponenten GmbH, Stuttgart, Fed. Rep. of Germany

[21] Appl. No.: 693,961

[22] Filed: Jan. 23, 1985

[30] Foreign Application Priority Data

Feb. 22, 1984 [DE] Fed. Rep. of Germany ..... 3406397

[51] Int. Cl.[4] ..... D01H 13/16; D01H 13/18

[52] U.S. Cl. ..... 57/87; 19/0.25; 19/244; 57/80; 57/81; 57/83; 57/86

[58] Field of Search ..... 57/50–87; 19/0.25, 244

[56] References Cited

U.S. PATENT DOCUMENTS

| | | | |
|---|---|---|---|
| 1,920,767 | 8/1933 | Scott | 19/0.25 |
| 3,309,859 | 3/1967 | Vehorn | 57/81 |
| 3,438,189 | 4/1969 | Gasser et al. | 57/81 |
| 4,213,290 | 7/1980 | Kupper | 57/87 X |
| 4,326,371 | 4/1982 | Soar | 57/87 |
| 4,432,195 | 2/1984 | Stahlecker | 57/87 |
| 4,450,677 | 5/1984 | Horvath et al. | 57/81 |
| 4,480,354 | 11/1984 | Glock et al. | 19/0.25 |
| 4,484,376 | 11/1984 | Glock et al. | 19/0.25 |
| 4,501,114 | 2/1985 | Horvath et al. | 57/86 X |
| 4,510,645 | 4/1985 | Glock | 19/0.25 |

*Primary Examiner*—John Petrakes

*Attorney, Agent, or Firm*—Murray Schaffer

[57] ABSTRACT

A draw frame for a spinning machine is provided with roving blocking mechanism associated with its inlet rollers actuable on rupture of the remittant thread to arrest movement of the roving and is further provided with a sensor for detecting the continuity of the roving being fed from a source of supply and a roving clamp situated between the sensor and the blocking mechanism. The blocking mechanism and the roving clamp are arranged to be simultaneously operated in response to a signal from the sensor or in response to rupture of the thread.

10 Claims, 2 Drawing Figures

ROVING BLOCKING MECHANISM ON DRAW FRAMES OF SPINNING MACHINES

BACKGROUND OF THE INVENTION

The present invention relates to apparatus for arresting and controlling a ruptured roving during operation of the draw frame of a textile spinning machine.

In U.S. application Ser. No. 387,193, filed June 10, 1982, now U.S. Pat. No. 4,501,114 (corresponding to German GE-OS31 23 476) and U.S. Pat. No. 4,484,376 issued on Nov. 27, 1984, (corresponding to German DE-OS P 31 00 049) both assigned to the assignee of the present application, a spinning machine is depicted in which each draw frame has a blocking device for arresting the ruptured roving. The blocking device may be activated by a sensor detecting the continuity of the roving being fed directly into the infeed rollers of the draw frame and/or by a sensor detecting the continuity of the thread discharged therefrom. Also, a second roving material incorporated into the basic thread after spinning can also be sensed.

When the blocking device is actuated by either one of the sensors noted, the roving is clamped and held at its entry into the first of the drawing rollers, resulting in the creation of a fiber tuft projecting from there toward the remaining drafting belts. When the blocking device is actuated by a sensor, arranged relatively prior to the entry to the rollers, the remainder of the roving, e.g., a piece broken off the roving supply or the end of the roving run off the supply spool, may still run completely into the draw frame with the result that the actuated blocking device runs idly, and does not secure a fiber tuft. Processing of material can, however, be stopped by actuation through the other sensors.

Although the blocking device known from the aforesaid application is provided with a handle which allows the deactivation of the blocking device, and resetting of the draw frame for operation, manual manipulation and several steps are still required for restarting of the spinning, i.e., providing a continuing roving supply, which are not dealt with by the aforementioned application. For example, when a blockage is caused by rupture or run out of the roving being fed from the supply spool through the draw frame, a connection to the roving supply must be first reestablished at a position outside of the draw frame, generally after the prior insertion of full supply spool. Thus, as previously mentioned, if the roving has completely run beforehand into the draw frame, or even if it is completely run beforehand into the draw frame, or even if it is projected out by only a slight degree, to the rear of the blocking site, connection with the forward end from the supply spool is impossible. It, therefore, becomes necessary to lift the upper rollers from contact with the lower rollers in order to insert the supply roving between the drawing rollers along the entire length of the draw frame.

The object of the present invention is directed to simplifying the task required for rejoining the roving within the draw frame to the roving supply and of assuring effective connection of the roving regardless of whether the rejoining is executed manually or with the aid of some mechanical apparatus.

A further object of the present invention is to provide an arrangement suitable for use on latterally coupled draw frames equipped with double upper rollers held in a support and load arm whereby rejoining of the roving and restarting of the spinning on one side has no influence or effect on the spinning rollers on the other side.

Other objects and advantages of the present invention are set forth in the following disclosure.

SUMMARY OF THE PRESENT INVENTION

In accordance with the present invention, the draw frames of a spinning machine are provided with a roving blocking device located at the point where the roving enters the rollers and a sensor detecting the continuity of the supply roving located at the rearmost point at the infeed point from the supply source so as to actuate the blocking device on the rupture of the roving entering from the supply source. The blocking device acts to lift the upper roller from the lower roller and hold the roving fast between itself and the upper roller so as to block its further movement. In addition, a roving clamp member is arranged in the area between the supply sensor and the blocking device so as to be capable of being actuated simultaneously with the blocking device into a holding position wherein the rear end of the roving is held. Thus, the roving is held not only at the rollers, but in a position closely adjacent the infeed of the roving from the supply so as to provide a tuft or portion at its rear end, freely available for reconnection to the roving supply.

The roving clamp provided between the supply sensor and the blocking device retains the rear end piece of the roving which has still not entered into the rollers of the draw frame. The sensor is arranged at such a long distance from the entry into the rollers of the draw frame that a roving end is provided, which is sufficiently long to enable its rejoining to the roving supply. Rejoining of the broken end with the roving supply can be simply effected by ordinarily twisting the two roving pieces together. Rejoining by machinery can be done, for instance, with a device movable alongside the machine, which grasps the roving end piece held fast by the holder and works the end by gripping arms or other joining means to the roving from the supply.

The free standing fiber tuft projecting into the draw frame forward of the blocking device is held by a roving support which guides the fiber tuft during its movement into the double belt twisting unit of the drawing rollers thus assuring trouble-free advance of the roving within the draw frame. In this manner a rather long length of roving is held in the draw frame from a point adjacent the infeed to the winding spool. It is, therefore, not necessary to lift the support arm receiving the upper rollers from contact with the lower driven rollers or to cause interruption of the associated series of rollers, acting on an independent roving in the adjacent frame when the rupture occurs adjacent to supply source.

Preferably, the supply sensor for the incoming roving, and the roving clamp associated therewith are mounted on a common carrier. This offers a favorable and simple means for fastening the components required for checking and maintaining the continuity of the roving and for holding the end of the roving. This permits an already operational machine to be subsequently retrofitted with the present invention. For practical reasons, the common carrier is a component of the general or normal roving blocking device such as the bearing arm for the other sensors or blocking devices associated with the exiting of the roving from, or its passage through the rollers.

The infeed roving sensor can be a mechanical device, but it is of a practical advantage to provide a photoelectric device to sense the infeed of the roving. Especially advantageous is the provision of an arcuate trough guideway between the infeed point and the clamping member, which is designed as an arcuate channel helping to direct the roving in its proper path. As such, the photoelectric cell and a light source can be arranged at its upper end within its internal periphery. The guideway also creates a supporting table, which by the development of its curvature, the end of the roving still protruding rearwardly from the roving clamp may be held. This supporting surface forms a favorable work surface for manually twisting together the ends of the roving and for piecing the roving together when automatic mechanical means are employed.

It is further preferable to couple the present invention with the roving support and holding means located between the initial infeed rollers of the draw frame and the twisting belts so that the forward end or tuft of an arrested roving can be held ready for start up and feeding to the drafting belts.

Full details of the present invention are set forth in the following description and are illustrated in the accompanying drawing.

DESCRIPTION OF THE INVENTION

Figure 1:
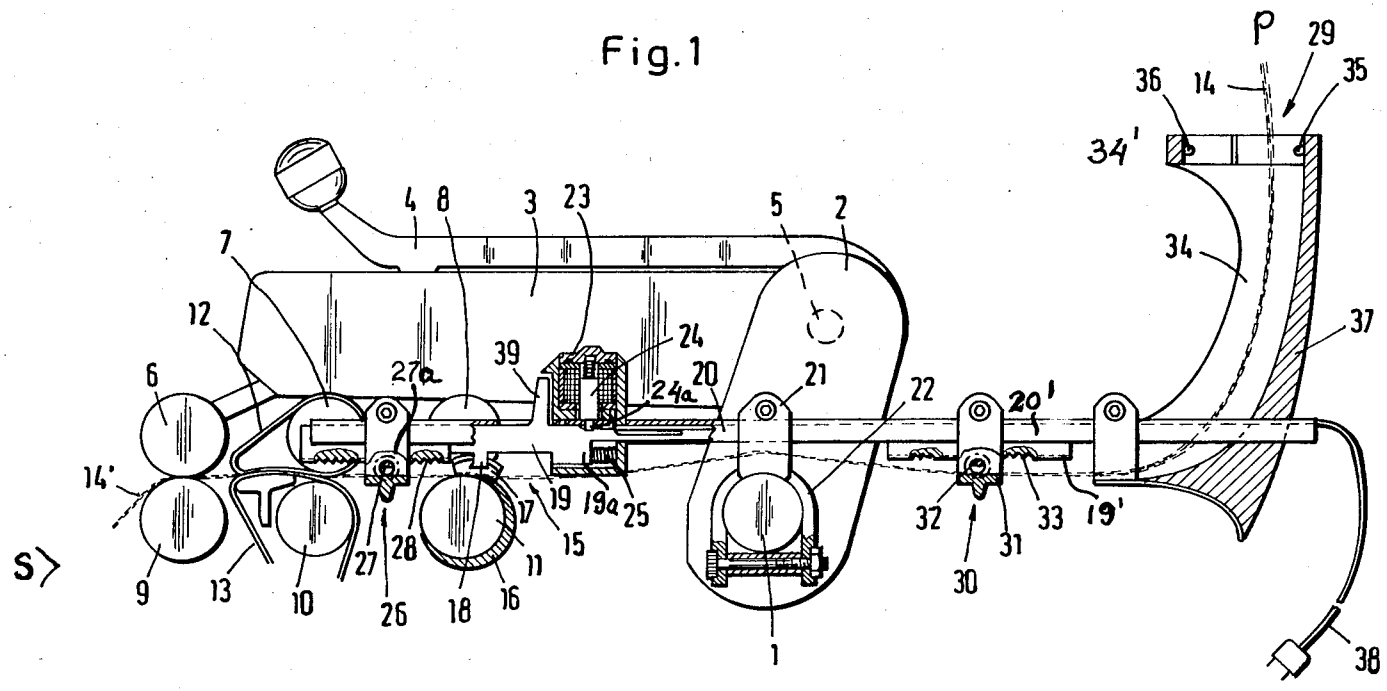
FIG. 1 is a side elevational view of a draw frame with a roving blocking device, a roving clamp device and a roving holder and infeed guide in accordance with the present invention.

In general, the present invention is applied to a conventional draw frame of such spinning machines as disclosed in the aforementioned U.S. application Ser. No. 387,193 and U.S. Pat. No. 4,484,376. Thus only those details as are necessary for an understanding of the present invention are set forth hereinafter and reference may be made to the aforementioned application and patent for other details which are, of course, incorporated herein by reference.

Each of the draw frames of the conventional spinning machine are mounted upon a supporting rod 1 which runs the length of the spinning machine transversely to a series of draw frames which are conventionally coupled in pairs. Fixedly mounted on the supporting rod 1 between adjacent couples of draw frames is a bracket support 2 on which is further pivotally mounted a load arm 3 which is provided with a handle 4. The load arm 3 is swingable about a bearing axle 5 so as to be movable in an upward-downward direction.

Depending from the load arm 3 to each side are the upper rollers 6,7, 8 for each of the coupled draw frames. The rollers 6, 7 and 8 are journalled in their respective axles so as to be freely rotatable. Fixedly mounted, by pairs, on each side of the frame of the spinning machine are the lower rollers 9, 10 and 11 which are driven to provide the forward motion for the roving and the twisting motion for converting the same into threads. The opposing rollers 7 and 10 are provided with endless belts 12 and 13 respectively, lower belt 13 running additionally over a curved palette. The slubbing or roving 14 is introduced into the draw frame at its rear end and is drawn through the first set of rollers 8 and 11 exiting at the front end from the draw frame as a thread 14'.

The continuity of the thread 14' exiting from the forward end of the draw frame is detected by a sensor S, and upon rupture or dicontinuance thereof provides a signal which activates a roving blocking device generally denoted by the numeral 15 which arrests the roving preventing it from passing completely through the rollers. The blocking device 15 comprises a shell 16 slidably arranged about the lower roller 11, which is provided with a laterally extending dome shaped projection 17 having a recess into which a stud 18 fits. The stud 18 depends from a slide member 19 which is mounted within a slot formed in a bearing rail 20. The bearing rail is arranged on the exterior side of the rollers and is secured firmly by a bracket 21 integral with clamp 22 which is itself securely fastened to the transversely extending supporting rod 1.

Figure 2:
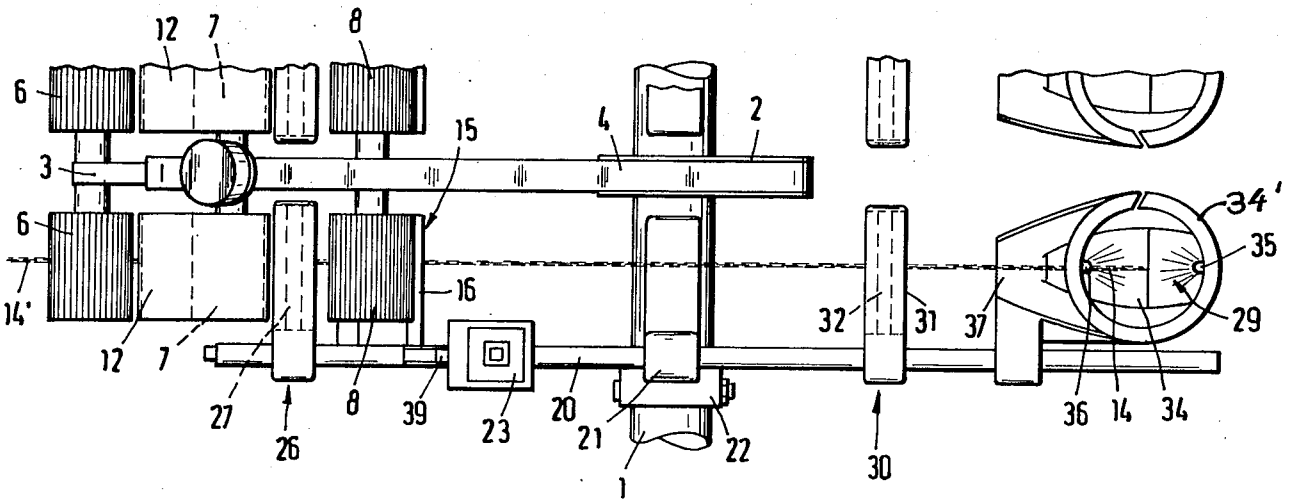
FIG. 2 is a plan view of the the draw frame shown in FIG. 1.

As seen in FIG. 2, the bearing rail 20 extends parallel to the generally horizontal path or line of travel of the roving 14. Seated on the bearing rail 20 prior to the infeed rollers 8, 11 is a housing 23 in which is located a solenoid 24, the armature of which forms a bolt **24*a*, which is adapted to fit within a notch 19*a* on the upper edge of the slide 19 so as to rest and lock the slide 19 in a fixed position. A compression spring 25, also located in the housing 23, bears against the rear edge of the slide edge 19 tending to bias the slide 19 toward the forward end of the draw frame and acting against the fixed position created by the engagement of the locking bolt 24*a* in the notch 19*a* on the upper edge of the slide 19**.

On retraction of the solenoid armature from the notch in the slide 19, by actuation of the solenoid, the compression spring 25 pushes the slide 19 forwardly thereby causing the shell 16 to rotate counter-clockwise about the roller 11 placing its wedge shaped edge between the lower roller 11 and the roving below the upper roller 8. The shell 16 clamps the roving 14 between itself and the roller 8 and simultaneously lifts the roller 8 from its engagement with the driven roller 11. Actuation of the solenoid 24 is obtained for example by a signal pulse emitted from the thread sensor S. Once the solenoid is activated, the movement of the slide 19 is automatic, under the force of the pressure spring 25.

A holder, generally depicted by the numeral 26 is located in the area between the shell 16 and the twisting belts 12 and 13, to support and hold the free-standing tuft created on rupture of the thread 14' from falling below the roving drawing line, and to subsequently assure the advance of the roving to the belts 12 and 13 so as to secure and complete its run-in on subsequent start up of the machine. The tuft holder 26 comprises a bracket having a table-like center generally depicted by the numeral 27 and which is fastened by a suitable clamp onto the bearing rail 20 so as to be adjustable in position lengthwise along the rail. To assure the retention of the tuft on the support-like table 27, a clamp member in the form of a rotary shaft **27*a* having a flat portion on one side is provided. The rotary shaft 27*a* is coupled by means of a pinion with the slide 19 which is provided with a rack 28 along its lower edge. In this way the rotary shaft 27*a* is turned simultaneously with the movement of the slide to clamp the roving tuft firmly against the table-like support 27. Thus, the tuft is held securely at its forward end immediately preceding the belts 12 and 13, even during the subsequent cleaning of belts 12 and 13 and rollers 6 and 9** with the conventional devices such as passing an air current through the machine.

As will be seen from the foregoing which is basically the construction of the aforementioned application and patent, there exists a relatively long span from the initial roving supply point P at the rear end of the machine to the first set of infeed rollers 8, 11. As a result, when the roving is ruptured in this area, a long stretch or tuft or roving may hang down into the machine, sometimes fouling the machine, but always presenting a problem on start-up of reattaching the roving to the thread, or to the portion of the roving held in the rollers, or of inserting the broken end into the rollers.

In accordance with the present invention, means are provided enabling the control of the broken roving to simplify its introduction and joining to a new roving, or to the ruptured end of a roving and its supply into the draw frame. The present invention provides a shaped roving guide 29 arranged at the rear end of the draw frame starting from the point P and a roving clamp 30 between the guide 29 and the transverse rod 1. To accommodate the roving guide 29 and the roving clamp 30 the bearing rail 20 is extended as at 20', a substantial distance to the rear of the supporting rod 1 as is the slide, shown at 19'. The guide 29 and roving clamp 30 are secured to the bearing rail by suitable clamp means so as to be adjustable along the length thereof in the most optimum position depending on the nature of the roving length of the guide, etc. The roving clamp 30 which is similar to the earlier described holder 26 includes a supporting table 31, as well as a rotary shaft 32 which is flattened on one side and which passes over the roving. The rotary shaft 32 is provided with a pinion which meshes with a rack edge 33 on the bottom of the slide extension 19'. Thus, movement of the slide 19 causes rotation of the rotary shaft 32, simultaneously with the operation of the blocking device 15 and the roving clamp 26 described earlier.

The roving guide 29 comprises an arcuate trough-like guideway 34 shaped at its upper end as an oval ring 34', split in its periphery, to permit entry of the roving, but easy retention once it starts its travel. In cross-section, as seen in FIG. 2, the guideway 34 is also arcutate; the resultant compound curvature assuring free and easy guidance of the roving to the rollers. The lower end of the trough guide-way terminates in a horizontal position, aligned with the line of travel of the roving in the draw frame, providing a table-like surface for the end of the ruptured roving.

A light source 35 and a photo sensitive cell 36 are arranged opposite to each other on the inner wall of the ring 34' so as to sense the passage of the roving 14 into the guideway 34. The sensor 36 is adapted to produce a signal pulse on rupture of the roving prior to its entry, which signal is delivered to the solenoid 24 in the same manner as the pulse signal from the sensor S on rupture of the exiting thread 14'. The roving guide 29 is formed as a unitary bond 37 which is mounted to the bearing rail 20, at its lower end.

Power to the electrical components is supplied by the cable 38 which is connected to the common power line for the spinning machine, and which extends through the bearing rail 20.

In accordance with the present invention, the guideway 34 terminates at its lower end in substantial horizontal portion leading directly toward the surface of the table 31 of the second roving holder 30. Thus, the roving makes a smooth transition from the supply end into the drawing line. The rupture or ending of the roving 14 from the supply at the rear or feed end of the drawing frame is sensed by the sensor 36. This signal activates the solenoid which causes movement of the blocking device 15 and both roving clamps 26 and 30 simultaneously. The rear end of the roving in the draw frame is held by the clamp 30 while the forward end is held by the clamp 26. Thus, the rear end of the roving, remains within the range of the roving guideway 34 so that the ruptured roving, or a new roving, from the supply can be reconnected or connected therewith whereby a continuing roving is established prior to entry into the rollers of the draw frame.

The roving blocking device 15 is also actuated at the same time as the roving clamp 30 capturing the fiber tuft within the draw frame along the drawing line so that the forward end of the roving is held ready for twisting within the belts 12 and 13 as soon as the cause for the rupture of the roving is removed. When the cause of the roving rupture is removed, the slide 19 is returned to its normally held position in engagement with the bolt **24*a* of the solenoid 24. To effect this, the slide 19 is provided with an upwardly extending handle 39 which can be manually manipulated by the operator of the machine. Once the slide 19 is returned to its normal position, both of the clamps 26 and 30 as well as the blocking device 15 are returned to their normal operating position which allows the roving 14 to run smoothly and freely through the draw frame. The forward end of the roving, now being the thread 14'** is conventionally connected to the thread previously wound upon a spool and continuous operation of the draw frame can be effected.

It will be noted from the foregoing, that the removal of the cause for any rupturing of the roving occuring between the supply and the first set of rollers and the reconnection of the new thread into the drawing frame itself is effected without the need to move or lift the load arm 3 or 4 disengage the rollers. Therefore, the adjacent spinning site of the paired rollers need not be disturbed and spinning at that site will not be interrupted. In other words, the stopping of drawing through one set of rollers does not effect the continued operation of its adjacent companion rollers in the paired drafting situs.

Various embodiments, modifications and changes have been mentioned here, other such variations will be obvious to those skilled in this art. Accordingly, the present disclosure is to be taken as illustrative and not as limiting of the present invention.

What is claimed:

1. A draw frame for a spinning machine adapted to convert a roving supplied from an external source into a thread, comprising aligned pairs of inlet rollers and drafting rollers through which said roving travels from said external source, sensing means for detecting the continuity of the roving as supplied to said inlet rollers from said external source, blocking means associated with said inlet rollers selectively actuable to arrest the movement of said roving through said inlet rollers, clamp means selectively actuable, to arrest the travel of said roving, said clamp means being located along the path of travel of said roving between said sensing means and said blocking means at said inlet rollers and roving support means located between said inlet rollers and said drafting rollers, and means responsive to the sensing by said sensing means of a breakage in said roving supplied from said external source for simultaneously activating said blocking means and said clamp means to arrest said roving, said clamp means, blocking means and support means being aligned along the path of travel of said roving so as to maintain said arrested roving along the path of travel in alignment with said paired inlet and drafting rollers and the end of said arrested roving in position for re-combination with the roving from said external source.

2. The draw frame according to claim 1 wherein said clamp means and said sensing means are mounted on a common carrier.

3. The draw frame according to claim 2 wherein said common carrier comprises a bearing arm mounted adjacent the length of said draw frame.

4. The draw frame according to claim 1, including an arcuate trough extending from said sensing means to a point close to said clamp means for guiding and supporting said roving from said external source to said clamp means.

5. The draw frame according to claim 4, wherein said trough is arcuate in cross section.

6. The draw frame according to claim 4 wherein the sensing means comprises a light source and a photosensitive cell facing each other on the inner wall of said trough at the rear most extremity.

7. A draw frame for a spinning machine adapted to convert a roving supplied from an external source into a thread, comprising upper and lower paired inlet rollers and drafting rollers through which said roving travels, blocking means associated with said inlet rollers selectively actuable to arrest the movement of said roving through said inlet rollers, sensing means for detecting the continuity of the roving supplied from said external source, clamp means actuable for holding said roving located along the path of travel of said roving between said sensing means and said blocking means, and means responsive to the sensing of a breakage in said roving supplied from said external source for activating said blocking means and said clamp means simultaneously to arrest said roving, including a supporting rail mounted to extend parallel to the direction of said roving movement, said clamp means being mounted on said supporting rail, said supporting rail including a slide member, a spring biasing said slide member toward said draftng rollers, switch means mounted on said supporting rail and adapted to releasably engage said slide when said slide is moved against the bias of said spring means, said slide being operable on release of said switch means to operated both said blocking device and clamp means simultaneously.

8. The draw frame according to claim 7 wherein said roving clamp means comprises a table mounted cantilevered below said roving and a shaped arm is mounted above said roving, said arm being rotatable synchronously with said blocking means into a first position to hold the end of said roving to said table, and into a second position to permit said roving to pass freely therebetween, said shaped arm having a pinion, and said slide having a rack engaging therewith to pivot said arm.

9. The draw frame according to claim 7 wherein said blocking device comprises a shell surrounding the lower one of the paired inlet rollers, said shell having a coupling extending at at least one of its ends to engage with the slide.

10. A draw frame for a spinning machine adapted to convert a single roving supplied from an external source into a thread, comprising upper and lower paired inlet rollers and drafting rollers through which said roving travels from said external source, blocking means associated with said inlet rollers selectively actuable to arrest the movement of said roving at said inlet rollers, clamp means actuable for holding said roving located upstream along the path of travel of said roving and guide means for directing said roving from said external source to said clamp means and sensing means located upstream of said clamp means responsive to the sensing of a breakage in said roving supplied from said external source for activating both said blocking means and said clamp means simultaneously to arrest said roving to thereby hold one end of said arrested roving at said inlet rollers and the other end of said arrested roving in the path of travel from said external source.

* * * * *